US010006651B1

(12) United States Patent
Myers

(10) Patent No.: US 10,006,651 B1
(45) Date of Patent: Jun. 26, 2018

(54) PERSONAL COOLING DEVICE

(71) Applicant: David J. Myers, Camp Verde, AZ (US)

(72) Inventor: David J. Myers, Camp Verde, AZ (US)

( * ) Notice: Subject to any disclaimer, the term of this patent is extended or adjusted under 35 U.S.C. 154(b) by 0 days. days.

(21) Appl. No.: 15/835,759

(22) Filed: Dec. 8, 2017

Related U.S. Application Data

(60) Provisional application No. 62/432,681, filed on Dec. 11, 2016.

(51) Int. Cl.

| | |
|---|---|
| ***B01F 3/04*** | (2006.01) |
| ***F24F 6/04*** | (2006.01) |
| ***F24F 13/02*** | (2006.01) |
| ***F24F 6/16*** | (2006.01) |
| *F24F 6/00* | (2006.01) |

(52) U.S. Cl.
CPC ..... *F24F 6/043* (2013.01); *B01F 3/04035* (2013.01); *B01F 3/04042* (2013.01); *F24F 6/16* (2013.01); *F24F 13/0272* (2013.01); *F24F 2006/008* (2013.01); *F24F 2221/12* (2013.01)

(58) Field of Classification Search
CPC ..... B01F 3/02; B01F 3/022; B01F 3/04007; B01F 3/04035; B01F 3/04042; F24F 6/04; F24F 6/043; F24F 6/12; F24F 6/16; F24F 13/0272; F24F 2006/008; F24F 2221/12
USPC ..... 261/30, 84, 107, DIG. 3, DIG. 43
See application file for complete search history.

(56) References Cited

U.S. PATENT DOCUMENTS

| | | | | |
|---|---|---|---|---|
| 1,652,392 | A * | 12/1927 | Clark | F24F 6/04 261/107 |
| 2,032,634 | A * | 3/1936 | Ross | F24F 6/04 261/107 |
| 2,164,763 | A * | 7/1939 | Buck | F24F 6/04 261/107 |
| 2,614,820 | A | 5/1949 | Boydjieff | |
| 3,045,450 | A | 7/1962 | Chandler | |
| 3,864,437 | A | 2/1975 | Blaszkowski | |
| 4,301,095 | A | 11/1981 | Mettler et al. | |
| 4,383,951 | A | 5/1983 | Palson | |
| 5,046,329 | A | 9/1991 | Travis, III | |
| 5,143,655 | A | 9/1992 | Chiu et al. | |
| 5,431,885 | A | 7/1995 | Zlotnik et al. | |
| 5,837,167 | A | 11/1998 | Lederer | |
| 6,050,551 | A | 4/2000 | Anderson | |
| 6,149,138 | A | 11/2000 | Birdsell | |
| 6,371,450 | B1 | 4/2002 | Davis et al. | |
| 6,378,845 | B1 | 4/2002 | Hsu | |
| 6,592,107 | B1 | 7/2003 | Wong | |

(Continued)

*Primary Examiner* — Charles Bushey
(74) *Attorney, Agent, or Firm* — Invention To Patent Services; Alex Hobson

(57) ABSTRACT

A personal cooling device utilizes a portable container for retaining a liquid that is wicked into a wicking, material and a fan to draw air into the container through a plurality of apertures to produce a flow of cool air. Air drawn into the container through the apertures flows through the wicking material and is cooled by evaporative cooling. The air then flows out of the top of the container and through the air moving device. A funnel is configured around the outer perimeter of the container to capture any liquid that spills out of the apertures and direct it back into the container. A battery pack may be coupled to the air moving device by an extension cable for storing the battery pack in a more convenient location, such as on a belt.

20 Claims, 12 Drawing Sheets

(56) References Cited

U.S. PATENT DOCUMENTS

| | | | | |
|---|---|---|---|---|
| 6,755,396 | B1 * | 6/2004 | Weinrich | B60H 3/022 261/30 |
| 6,938,883 | B2 * | 9/2005 | Adams | A61L 9/122 239/44 |
| 7,677,536 | B2 | 3/2010 | Wang et al. | |
| 7,997,565 | B1 | 8/2011 | Chan | |
| 9,205,218 | B1 * | 12/2015 | Bachan | A61M 16/105 |
| 2007/0022964 | A1 | 2/2007 | Reusche et al. | |
| 2007/0257383 | A1 | 11/2007 | Chan | |
| 2009/0057931 | A1 | 3/2009 | Wang et al. | |
| 2009/0143004 | A1 * | 6/2009 | Tam | F24F 5/0035 454/284 |
| 2015/0338119 | A1 | 11/2015 | McGarva et al. | |

* cited by examiner

PERSONAL COOLING DEVICE

CROSS REFERENCE TO RELATED APPLICATIONS

This application claims the benefit of priority to U.S. provisional patent application No. 62/432,681, filed on Dec. 11, 2016; the entirety of which is hereby incorporated by reference herein.

BACKGROUND OF THE INVENTION

Field of the Invention

This invention relates to personal cooling devices and particularly portable evaporative cooling devices.

Background

Outdoor activities become very uncomfortable when the temperature gets too hot. Many people avoid going outdoors or limit their outdoor activities to mornings or evening when the temperature is not as high. This limits people's activities and can make it difficult to complete outdoor chores, such as mowing the grass. Misting devices are sometimes used to cooling however they produce water droplets that can dampen clothes and fog up glasses.

SUMMARY OF THE INVENTION

The invention is directed to a personal cooling device that produces a flow of cool air through evaporative cooling. The personal cooling device utilizes a portable container for retaining a liquid that is wicked into a wicking material and a fan to draw air into the container through a plurality of apertures to produce a flow of cool air. Air drawn into the container through the apertures flows through the wicking material and is cooled by evaporative cooling. The air then flows out of the top of the container and through the air moving device. A funnel is configured around the outer perimeter of the container to capture any liquid that spills out of the apertures and direct it back into the container. A battery pack may be coupled to the air moving, device by an extension cable for storing the battery pack in a more convenient location, such as on a belt. A person may strap the personal cooling device around their neck, onto a backpack, or onto a shoulder harness to go about their outdoor activities while being cooled by a flow of cool air. The personal cooling device of the present invention greatly increase a person's comfort while doing outdoor actives in hot conditions.

The container of the personal cooling device is portable and can be carried easily in a person's hand. The container may be any shape, but preferably has a rounded or circular outer perimeter, as the container may be strapped around a person's neck. Sharp edges may be uncomfortable and would make sealing of, the funnel more difficult. The container may have a changing cross-length dimension or diameter along the length. Put another way, the container may be hour-glass shaped or may have a more abrupt change in diameter, or a step to prevent the funnel from sliding up too high, or too low along the length. The container has a length from a bottom to the top of the container. The length may be no more than about 20 inches, no more than about 15 inches, no more than about 12 inches, no more than about 9 inches and any range between and including the length values provided. Likewise, the container may have a diameter, or cross-length dimension that is no more than about 10 inches, no more than about 8 inches, no more than about 6 inches and any range between and including the cross-length dimensions or diameters provided. The container is to be portable and have dimensions to allow it to be grasped around the length by a person with one hand, like a bottom of soda, for example. The volume of the container may be no more than about 2 liters, no more than about 1.5 liters, no more than about 1.0 liter, no more than about 0.8 liter and any range between and including the volumes provided. Again, if the container is going to be donned around a person's neck, a container that is too large is not practical. Water is heavy and carrying more than about a liter may become uncomfortable. The container may be made out of any suitable material but is preferably made out of a light-weight material, such as plastic or a thin wall metal. It could also be made out of glass but this is not preferred.

In an exemplary embodiment, the container is curved to prevent spilling when the personal cooling device is tilted, such as when worn by a bicyclist. The reservoir portion of the container may extend along an axis that is at an offset angle from the cooling portion or the axis of the top opening of the container. The container may have a gradual curve or may have one or more bends. An axis extending perpendicularly through the bottom may be at an offset angle to an axis extending perpendicularly through the cooling portion of the container and this offset angle may be 20 degrees or more, 30 degrees or more, 45 degree or more, 60 degrees or more an any angle between and including the offset angles provided.

The container has a plurality of apertures to allow air to be drawn in by the air moving device. The apertures are configured proximal to the top of the container, such as at least 50% of the length up from the bottom, at least 70% of the length up from the bottom, at least 80% of the length up from the bottom, at least 90% of the length up from the bottom and any range between, and including the percentages of the length up from the bottom provided. The apertures may be any shape including but not limited to oval, circular, polygonal, irregular and the like. The apertures may be configured substantially around the entire perimeter of the container, wherein there is at least one aperture every 90 degrees around the perimeter of the container. In an exemplary embodiment, there is at least one aperture every 60 degrees, or every 45 degrees, or every 30 degrees or every 20 degrees around the perimeter of the container. The greater the total open area of the apertures, the less resistance there is for flow. In addition, when the apertures are configured around the perimeter, there is more flow through the wicking material and therefore more evaporative cooling. One or more, and in some embodiments, all of the apertures, have an, opening dimension, such as length, width, or diameter, of at least 2 mm, at least 4 mm, at least 6 mm, at least 8 mm and any range between and including the aperture dimensions provided. If the size of the apertures is too small, it may put too much strain on the air moving device or produce too much resistance to airflow.

The funnel is configured to wrap around the perimeter of the container and have, an extended end that is elevated from the contacting portion, or where the funnel is in contact with the container. The funnel may be rigid and integral to the container or may be soft, flexible and/or elastic material that can be deformed and will elastically return to an original shape, such as a foam or an elastomeric material including, but not limited to urethan, silicone, rubber and the like. It is preferred that the funnel be a soft material so that it is not uncomfortable when it is jostling around a person neck and resting against their chest. A funnel has a width, or the length of the funnel from the contacting portion to the extended end that is about 10 mm or more, about 15 mm or more, about 2511117) or more, about 35 mm or more, about 40 mm or more and any range between and including, the widths provided. The funnel may comprise a lower portion that extends from a lower contacting portion, that extends around the outer perimeter of the container to an extended end. The funnel may be open to receive liquid that is funneled by the lower funnel portion into the container through the plurality of apertures in the container. A funnel may have an open top, and an open space between the extended end and the container to receive fluid. A funnel may further comprise an upper portion that extends from the extended end to an upper contacting portion, to form a funnel enclosure. The upper contacting portion may extend around the outer perimeter of the container above the plurality of apertures in the container and the lower contacting portion may extend around the outer perimeter of the container below the plurality of apertures in the container, thereby enclosing the plurality of apertures in the container. The upper portion of the funnel may have one or more funnel apertures for receiving a flow of air into the funnel that subsequently flows through the plurality of container apertures and into the container. The funnel may have apertures configured in one portion of the perimeter of the funnel, such as only on one side, or in one quarter of the radius around the funnel, or may be configured substantially around the perimeter of the funnel or container, wherein there is at least one funnel aperture in a 90 degree span around the perimeter of the container.

The air moving device may be a fan, or pump or any other suitable air moving device that can be effectively configured into a portable size for coupling to the container. The air moving device may be configured to detachably attach to the container. The container may comprise a threaded top that is used to couple with the air moving device. In another embodiment, the container has interference ring, such as an O-ring protrusion, that requires the air moving device to be pressed to extend over the interference ring to secure the air moving device to the container. Any suitable detachably attachable connection of the air moving device to the container may be employed. The container or air moving device may comprise a flexible portion that allows the air moving device to be moved relative to the container to allow directing the flow of cool air in a desired direction. For example, an exemplary container may have a corrugated portion, proximal to the top and where the air moving device couples to the container. Likewise, the air moving device may comprise a corrugated extension that couples with the container. A corrugated portion may allow directing the axis of flow of cool air at an offset angle to the length axis of the cooling portion of the container.

A wicking material is configured inside of the container and extends over the apertures and down into the container, such as all the way to the bottom or proximal to the bottom. It is desired that the wicking material be capable of wicking all, or substantially all of the liquid up to the apertures. The wicking material may be configured in a ring and extend around the interior perimeter or along the inside wall of the container. The wicking material may be configured in a ring over the apertures but may fill or substantially fill the volume of the container below the apertures. If the wicking material is too thick in the area of the apertures, it may create too much or an increase resistance for the air moving device. However, it may be desirable to fill or mostly fill the volume of the container below the apertures to prevent splashing of the liquid retained therein. The wicking material may be any suitable wicking material such as a natural fiber type wicking material, including a cellulosic wicking material, or a synthetic wicking material and the like.

The air moving device may be powered by a battery pack that is coupled to the air moving device or to the container, or is attached to the air moving device by an extension cable. It may be desirable to keep the weight of the personal cooling device to a minimum, since it may be hung around a person's neck, and therefore a remote battery that is coupled by an extension cable may be preferred. In an exemplary embodiment, a person may place the battery pack in their pocket, attach it to their belt or backpack and extend the extension cable to the air moving device.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
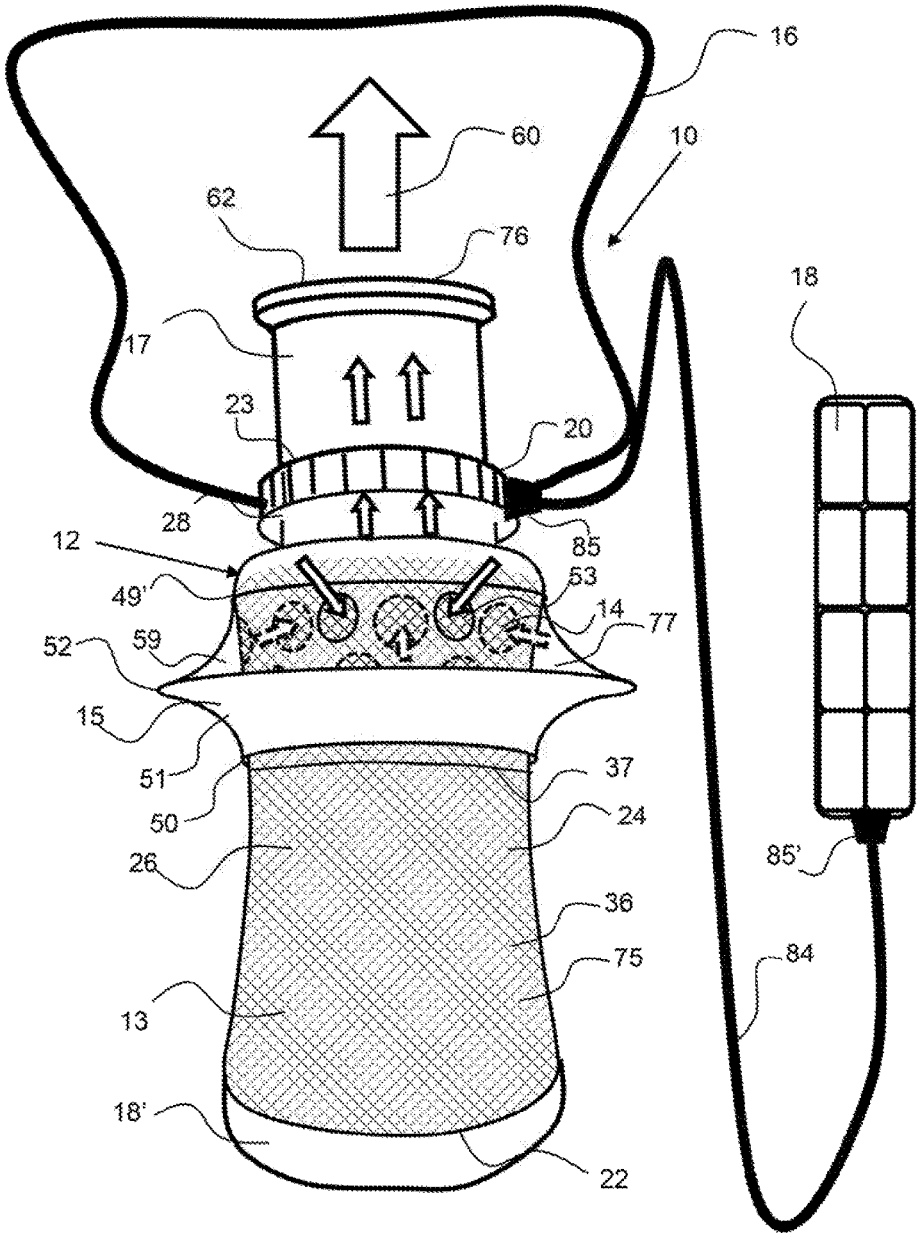
FIG. 1 shows a side view of an exemplary personal cooling device having a container for retaining a water, a wicking material, a plurality of apertures for receiving airflow into the container and an air moving device to draw said airflow into the container through the wicking material to produce a flow of cool air out of the top of the container.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in, the art and all such alternate embodiments, combinations, modifications, improvements are within the scope of the present invention.

As shown in FIG. 1, an exemplary personal cooling, device 10 has a container 12 for retaining a liquid 36, such as water, a wicking material 13, a plurality of apertures 14 for receiving airflow into, the container and an air moving device 17 to draw said airflow into the container and then through the wicking material to produce a flow of cool air 60 out of the top of the device 76. The container has a funnel 15 configured to capture water when is spills out from the apertures and direct it back into the container. The funnel extends out from a lower contacting portion 50, contacting the container, at an incline angle from the container to an extended end 52 to define a funnel portion 51 of the funnel. The funnel portion of the funnel funnels liquid into the container, through the plurality of apertures 14 in the container. The funnel has a cover portion 59 that extends from the extended end 52 to the upper contacting portion 49. The cover portion, further retains any liquid that might leak from the container into, the funnel enclosure. In an exemplary embodiment the funnel captures water that leaks or spills from the apertures in the contain between the funnel and the lower contacting portion which may extend completely around the perimeter of the container. Likewise, the upper contacting portion may extend completely around the perimeter of the container to create an enclosed space within the funnel that may have apertures to allow airflow into the funnel enclosure and through the apertures in the container. An exemplary cover portion 59 of the funnel has a plurality of funnel aperture 53 for receiving a flow of air.

A battery pack 18, or 18' is configured to provide an electrical power supply to the air moving device. A battery pack 18' is configured at the bottom 22 of the container and a separate battery pack 18 is coupled to the air moving device by an extension cable 84 having extension couplings 85, 85'. The wicking material 13 extends down from the apertures into the volume 26 of the container. The wicking material preferably extends down to the bottom of the interior volume of the container to enable all the liquid to be wicked up into the wicking material. The air moving device is attached to the top 20 of container by an attachment feature and may be detachably attachable. Air is drawn into the container by the air moving device 17, through the plurality of apertures 14. The air flowing through the wicking material is cooled by evaporative cooling and then travels out of the top opening 23 in the container and through the air moving device to produce a flow of cool air 60.

Figure 2:
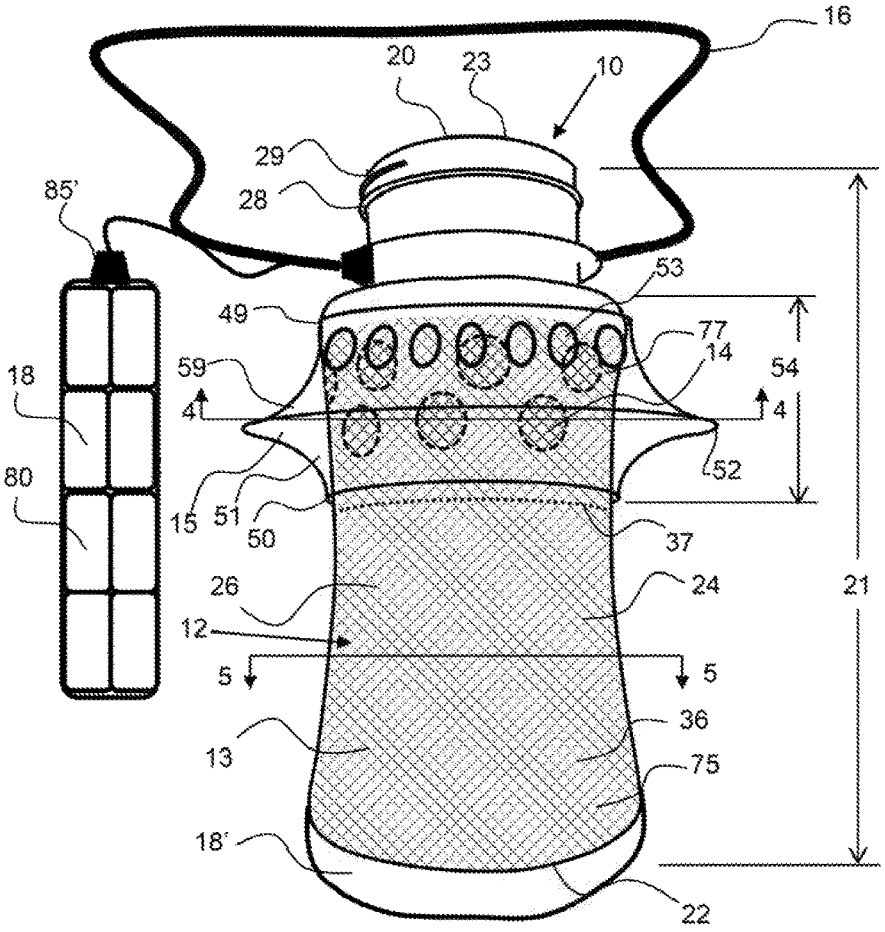
FIG. 2 shows a side view of an exemplary container 12 of a personal cooling device.

As shown in FIG. 2, an exemplary container 12 of a personal cooling device 10 that has a funnel 15 configured to capture water 36 that may leak through the plurality of apertures and direct said water back into the container. The liquid level 37 is below the bottom of the funnel 15. When the personal cooling device is jostled, such as when a person is doing outdoor activities, the liquid 36 may leak through the plurality of apertures and return back into the container. The attachment feature 28 for attaching the air moving device comprises threads 29. The air moving device may have mating threads to allow detachable attachment of the air moving device. The container has a length 21 from the bottom 22 of the container to the top 20 of the container. The funnel 15 has a length 54 from a lower contacting portion 50 to an upper contacting portion 49. The container has a circular cross-sectional shape. The battery pack 18 comprises a plurality of batteries 80.

Figure 3:
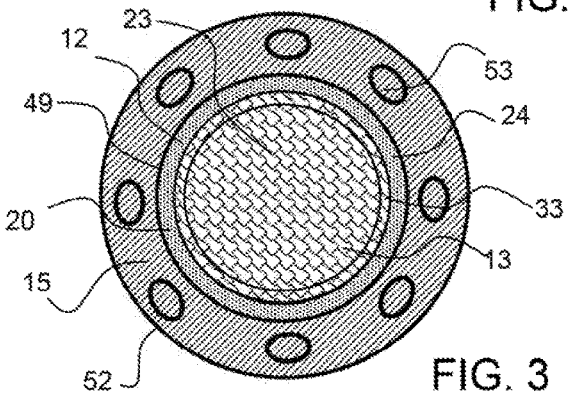
FIG. 3 is a top view of the container shown, in FIG. 2.

As shown in FIG. 3, the exemplary container 12 has a funnel 15 configured around the outer perimeter 24. The funnel has an upper contacting portion 49 that is in contact with the outer perimeter of the container and an extended end 52. The top 20 of the container and the top opening 23 are also shown in FIG. 3. The wicking material 13 fills the bottom portion of the container but has a thickness around the interior perimeter in the area of the apertures, or the portion of the height of the container from the bottom to the top of the plurality of apertures. The wicking material may be a wicking ring 33 in the area of the apertures.

Figure 4:
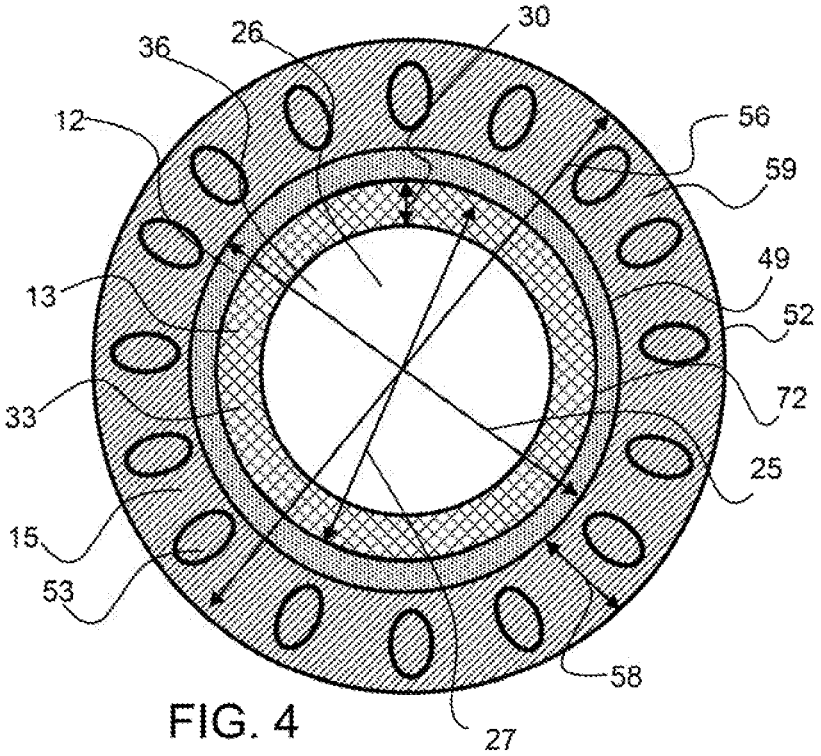
FIG. 4 is an enlarged cross-section view of the exemplary personal cooling device shown in FIG. 2 taken along line 4-4.
Figure 5:
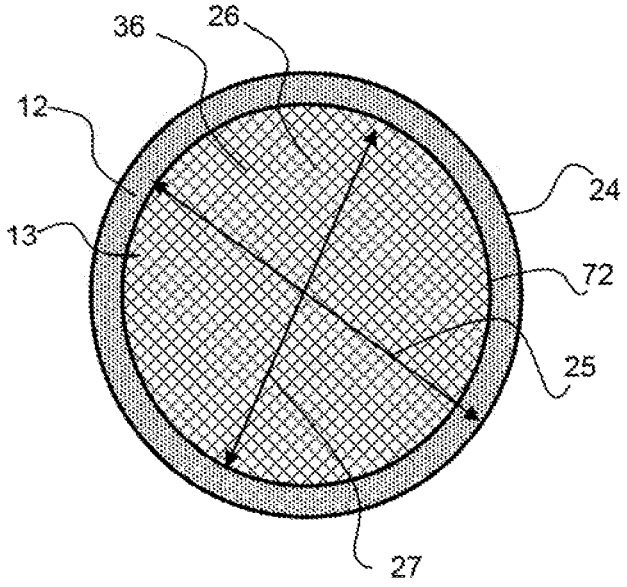
FIG. 5 is an enlarged cross-section view of the exemplary personal cooling device shown in FIG. 2 taken along line 5-5.

As shown in FIG. 4, an enlarged cross-section view of the exemplary personal cooling device shown in FIG. 2 taken along line 4-4, the funnel 15 has an upper contacting portion 49 and an extended end 52. The funnel may be slid up and down the length of the container as it may have an interference fit and be made out an elastic material, such as rubber or foam, as described herein. The funnel may also be an integral part of the container and be attached along the lower contacting portion 50 and/or the upper contacting portion 49. The wicking material 13 is configured around the interior perimeter 72 of the container 12 to cause the air drawn into the container to flow through the wicking material. The wicking material is a wicking ring 33 having a thickness 30 in the area of the apertures. The wicking material may fill the bottom portion of the container, as shown in FIG. 5, to better retain the liquid and prevent splashing. The wicking material may however extend as a ring around the interior perimeter in the area of the apertures to reduce the pressure drop produced for the flow of air into and through the wicking material. The thickness 30 of the wicking material may be some portion of the radius of the container, such about 5% or more, about 10% or more, about 30% or more, about 50% or more, about 75% or more or may fill the container completely in the area of the apertures. The diameter of the funnel 56 is greater than the diameter of the container 25 and has a width 58, or distance from the contacting portion to the extended end. The upper portion of the funnel or the portion from the extended end 52 to the upper contacting portion 49 has a plurality of funnel apertures 53. There is a funnel aperture within every 90 degrees about the perimeter of the container or funnel and therefore the funnel apertures are configured substantially around the perimeter of the funnel. The container has an inner diameter 27 and interior volume 26 for retaining a liquid 36, such as water.

As shown in FIG. 5, an enlarged cross-section view of the exemplary personal cooling device shown in FIG. 2 taken, along line 5-5, the wicking material 13 extends across and substantially fills the interior of the container below the plurality of apertures. There may be less propensity of water to spill if the water is retained in a wicking material within the volume 26 of the container 12 below the plurality of apertures, or from the bottom of the container to some height up from the bottom and below the plurality of apertures.

Figure 6:
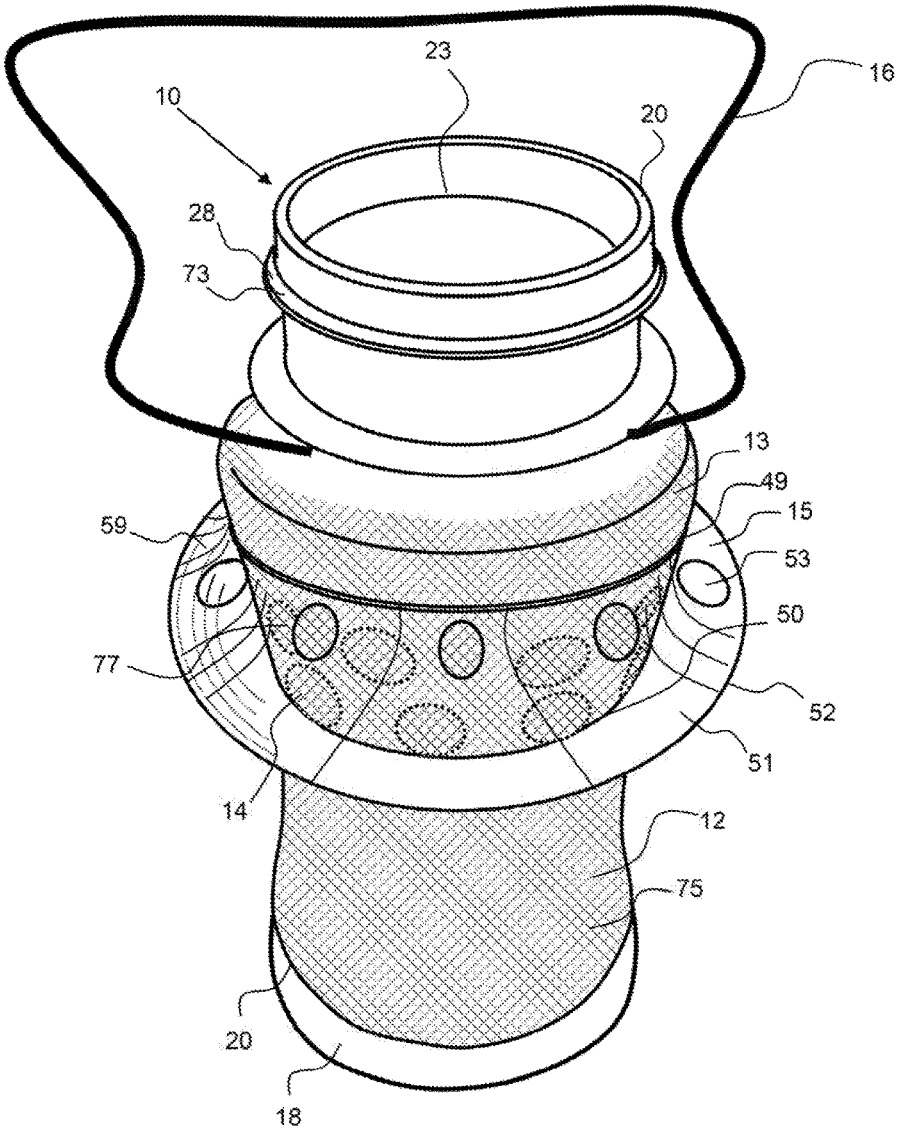
FIG. 6 is a perspective view of an exemplary container having a top opening for attachment of the air moving device and a funnel configured around the outer perimeter of the container.

As shown in FIG. 6, an exemplary container 12 has a top opening 23 in the top 20 of the container. An air moving device, not shown, is coupled over the top opening 23 to drawn air from the container. An attachment feature 28, could be an interference ring or threaded connector configured around the outer perimeter 24 of the container, proximal to the top 20. An air moving device may slide down and expand over the interference ring or thread onto threaded connector to detachably attach to the container. The funnel extends down from the extended end 52 to the lower contacting portion 50 to funnel water back down into the plurality of apertures 14. The contacting portion of the funnel is just below the bottom of the plurality of apertures for the purposes of preventing water leakage from the apertures. The funnel extends from the extended end to the upper contacting portion 49' to create a funnel enclosure having a plurality of funnel apertures 53 for drawing air into the funnel enclosure and subsequently through the container apertures 14 and into the container 12.

Figure 7:
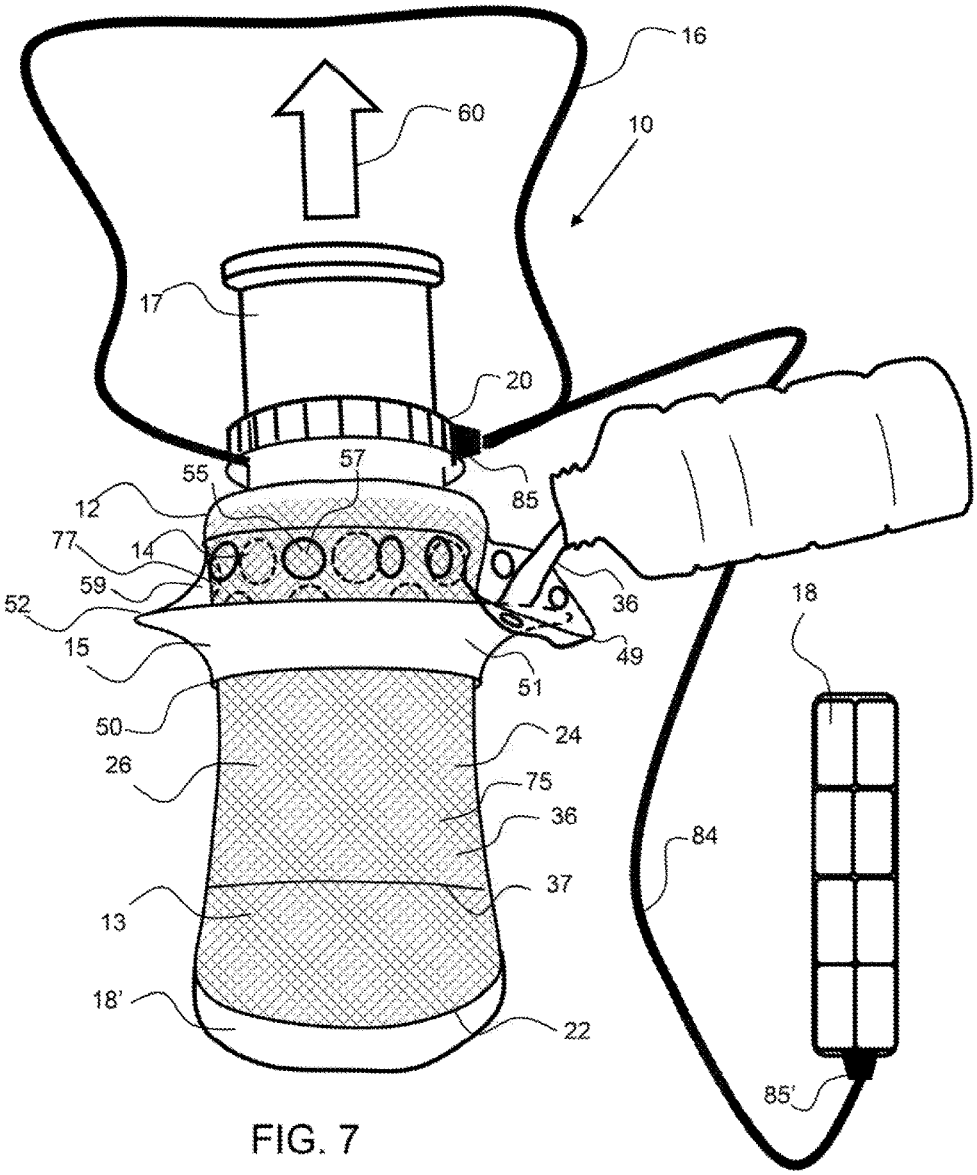
FIG. 7 shows a side view of an exemplary personal cooling device being filled with water.

As shown in FIG. 7, an exemplary personal cooling device 10 is being filled with water 36. The liquid is being poured into the funnel 15 and the funnel is directing the water into the container through the plurality of apertures 14. The funnel is made out of an elastomeric material that can be deformed, such as by pulling the upper contacting portion 49 away from the container for filling and then return to an original shape. A funnel may also comprise a fill port 55 that may have a fill port, cover 57 or the liquid, may be introduced into the funnel through one of the funnel apertures. The funnel apertures may be small in size and the fill port may be larger, making, it easier to fill the container and the port cover may prevent leakage of liquid, from the funnel when in use.

Figure 8:
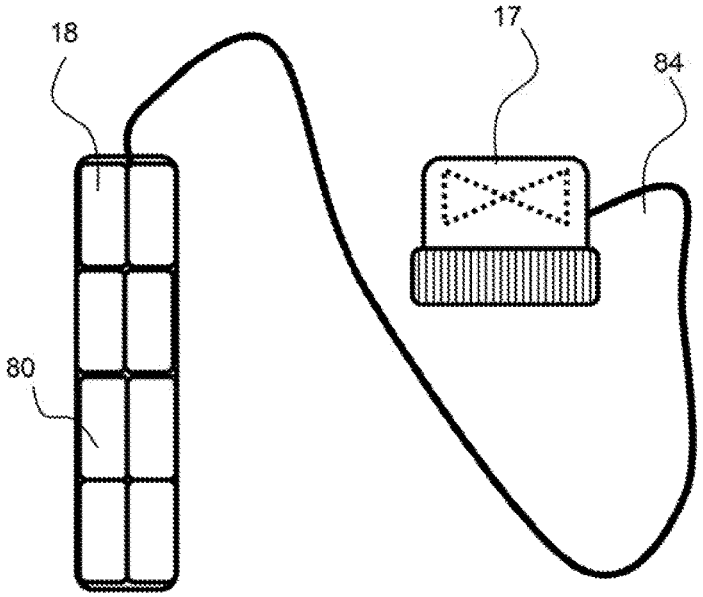
FIG. 8 shows a diagram of an exemplary air r roving device and a battery pack coupled thereto by an extension cable.

As shown in FIG. 8, an exemplary air moving device 17 and a battery pack 18 are coupled together by an extension cable 84. As described herein, an extension cable may allow a user to place the battery pack on a belt clip, in their pocket, in a backpack or water pack, for example.

Figure 9:
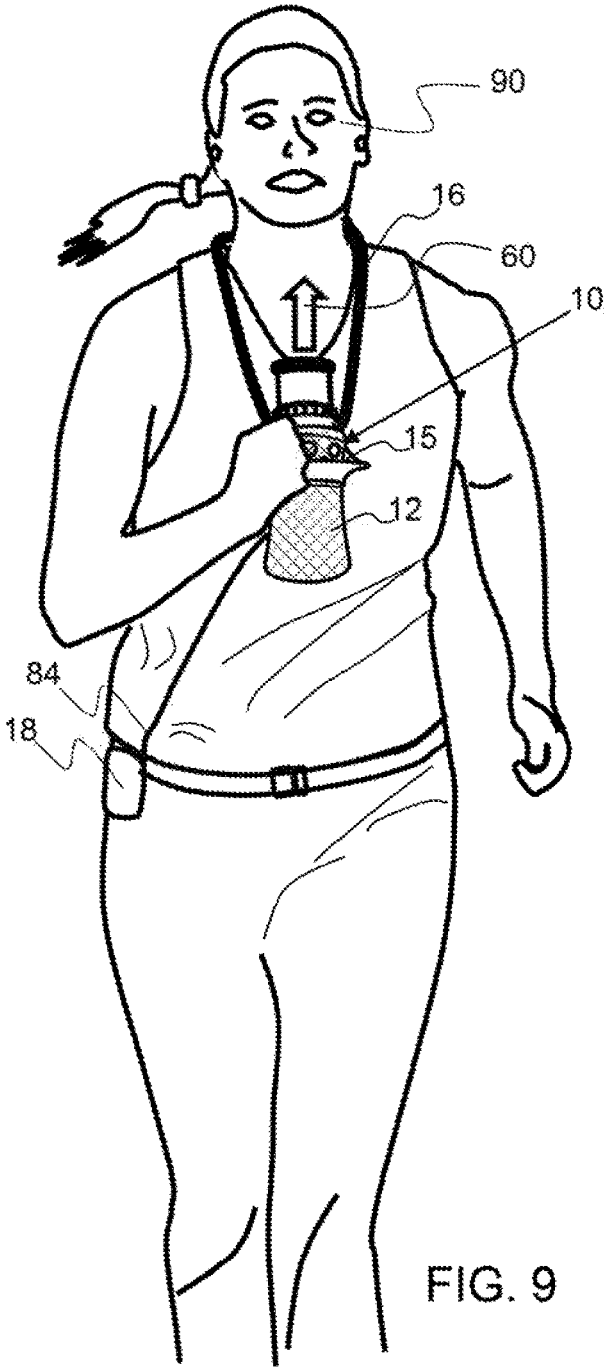
FIG. 9 shows a woman running with an exemplary personal cooling device hanging from a strap around her neck.

As shown in FIG. 9, a woman 90 is running with an exemplary personal cooling device 10 hanging from a strap 16 around her neck. The flow of cool air 60 is directed up at the woman's head. The battery pack 18 is coupled to the woman's belt and the extension cable 84 extends from the battery pack to the air moving device.

Figure 10:
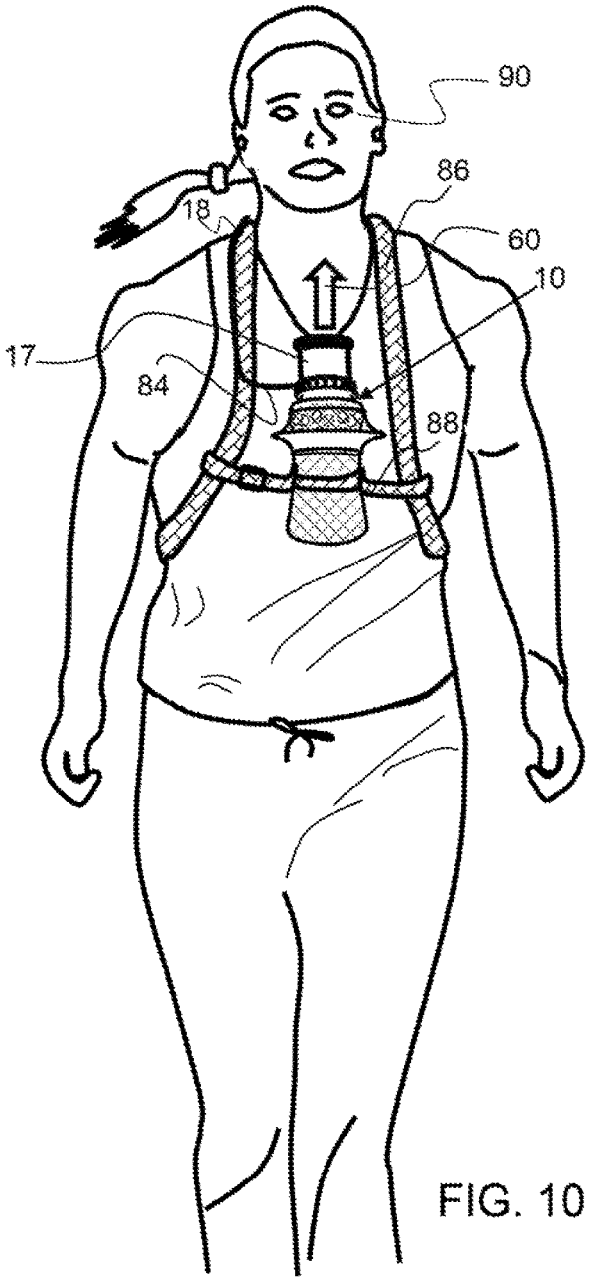
FIG. 10 shows a woman walking with an exemplary personal cooling device coupled to a backpack and the battery pack configured in the backpack.

As shown in FIG. 10, a woman 90 is walking with an exemplary personal cooling device 10 coupled to a backpack 86 and the battery pack 18 is configured in the backpack. The personal cooling device is retained to the strap 88 of the backpack. The extension cable 84 extends from the personal cooling device or air moving device 17 over the woman's shoulder to the enclosure of the backpack. There may be no need for a strap to extend around the user's neck in this embodiment, as the personal cooling device is secured to the backpack as shown.

Figure 11:
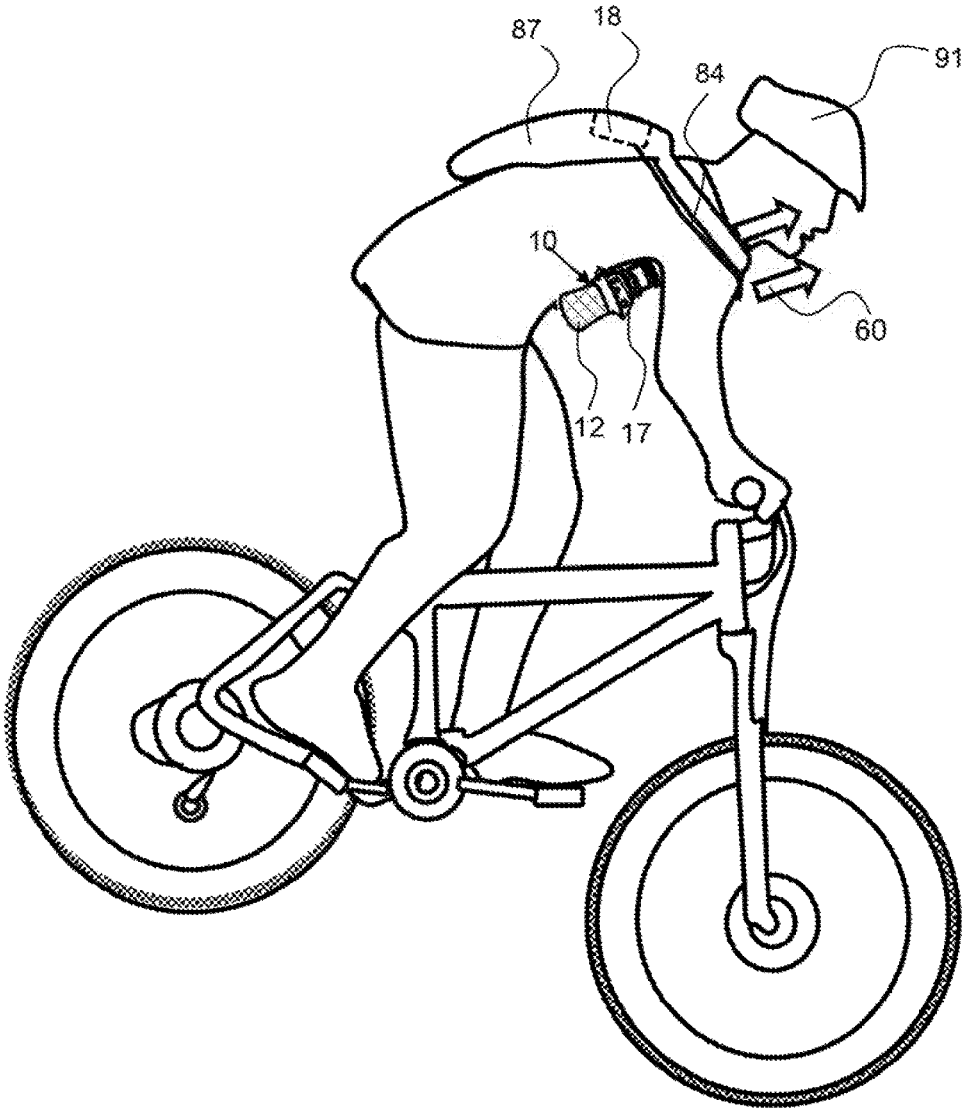
FIG. 11 shows a side view of a biker having an exemplary personal cooling device coupled to a water pack.

As shown in FIG. 11, a biker 91 has an exemplary personal cooling device 10 coupled to a water pack 87. The personal cooling device is configured to produce a flow of cool air 60 that is directed up at the biker's head. The container 12 is configured below the biker's head and may be configured within the biker's garment. The extension cable 84 extends from the air moving device 17 to the water pack where the battery pack 18 is stored.

Figure 12:
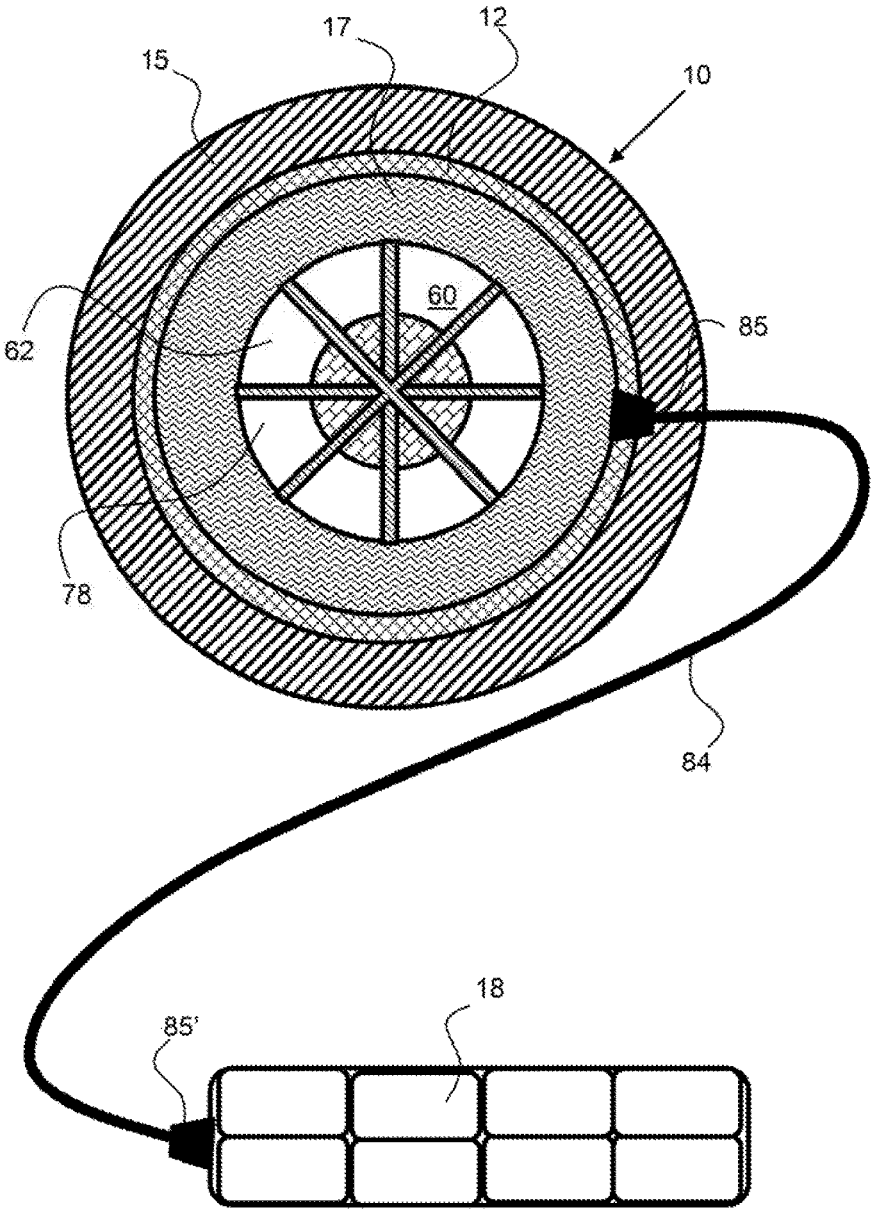
FIG. 12 shows a top view of an exemplary personal cooling device having an air moving device configured over the top opening of the container and a battery back coupled to the air moving device by an extension cable.

As shown in FIG. 12, an exemplary personal cooling device 10 has an air moving device 17 configured over the top opening of the container 12 and a battery back 18 coupled to the air moving device by an extension cable 84. The air moving device 17 has apertures 78 for the flow of cool air 60 from the air moving device exhaust 62.

Figure 13:
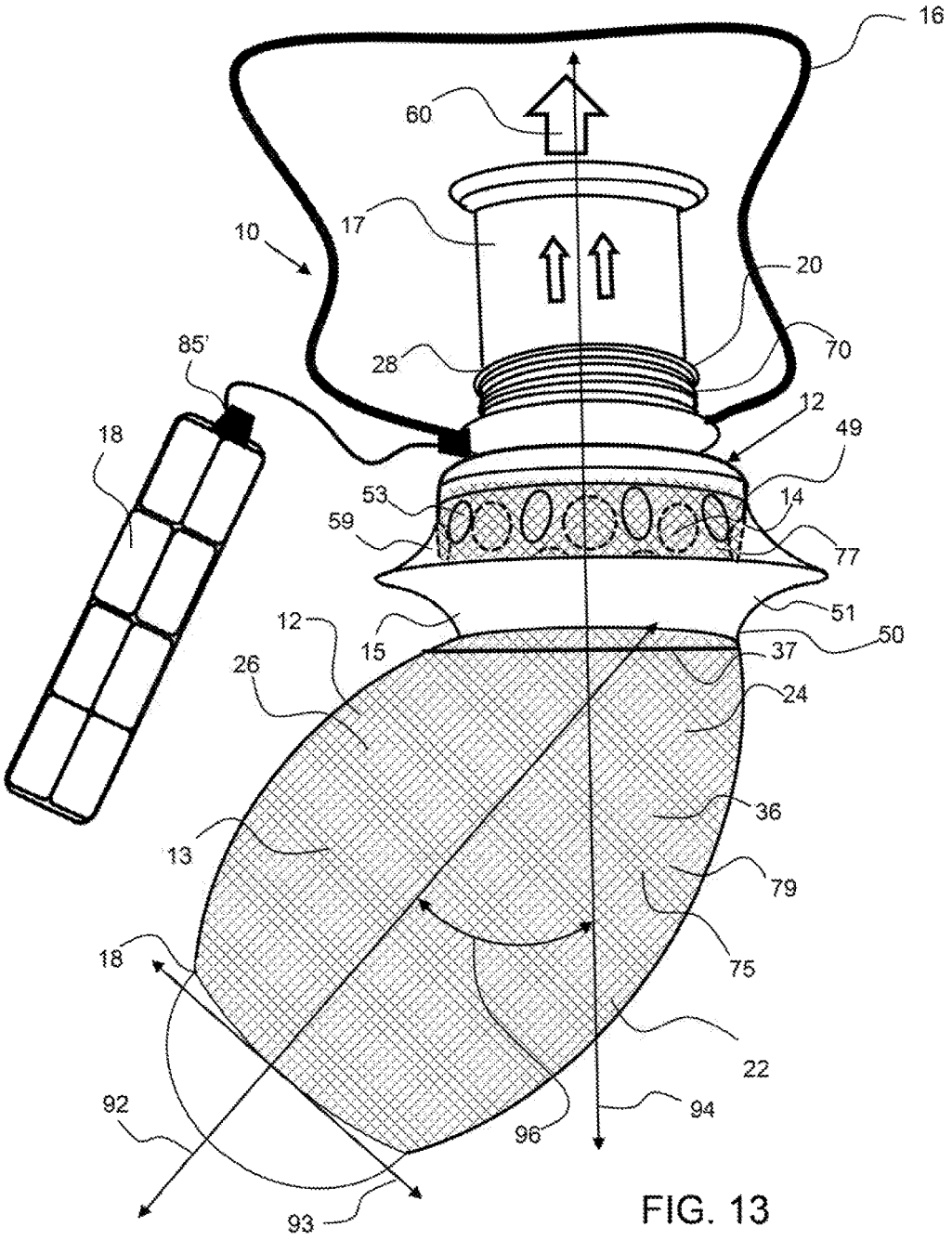
FIG. 13 a side view of an exemplary personal cooling device having curved container along the length and a flexible portion for directing the flow of cool air.

As shown in FIG. 18, an exemplary personal cooling device 10 has a curved container 79 that is curved along the length and a flexible portion 70 for directing the flow of cool air 60. A curved container 79 may reduce the likelihood of water container therein from spilling when the container is jostled. The flexible portion 70 may comprise corrugations that allow the air moving device 17 to be aimed in a desired direction. A bottom axis 92, or axis extending perpendicularly through the plane of the bottom 93 is at an offset angle 96 to the top axis 94, extending perpendicularly through the cooling portion of the container, and this offset angle may be 20 degrees or more, 30 degrees or more, 45 degrees or more, 60 degrees or more an any angle between and including the offset angles provided. This offset angle 96 allows the personal cooling device to prevent spillage of water through the apertures when tilted, as a large volume of water is retained in the reservoir portion 75 of the container. The bottom axis 92 is a line drawn generally through a plane of the bottom of the container, and as shown in FIG. 13 extends generally in the length direction of the reservoir portion 75 of the container 12. The top axis 94 is a line drawn generally through a plan of the cooling portion 77 of the container or through a plan of the top opening of the container when the flexible portion 70 of the container is configured with the air moving device. This container has a bend between the cooling portion 77 of the container and the reservoir portion 75 of the container.

Figure 14:
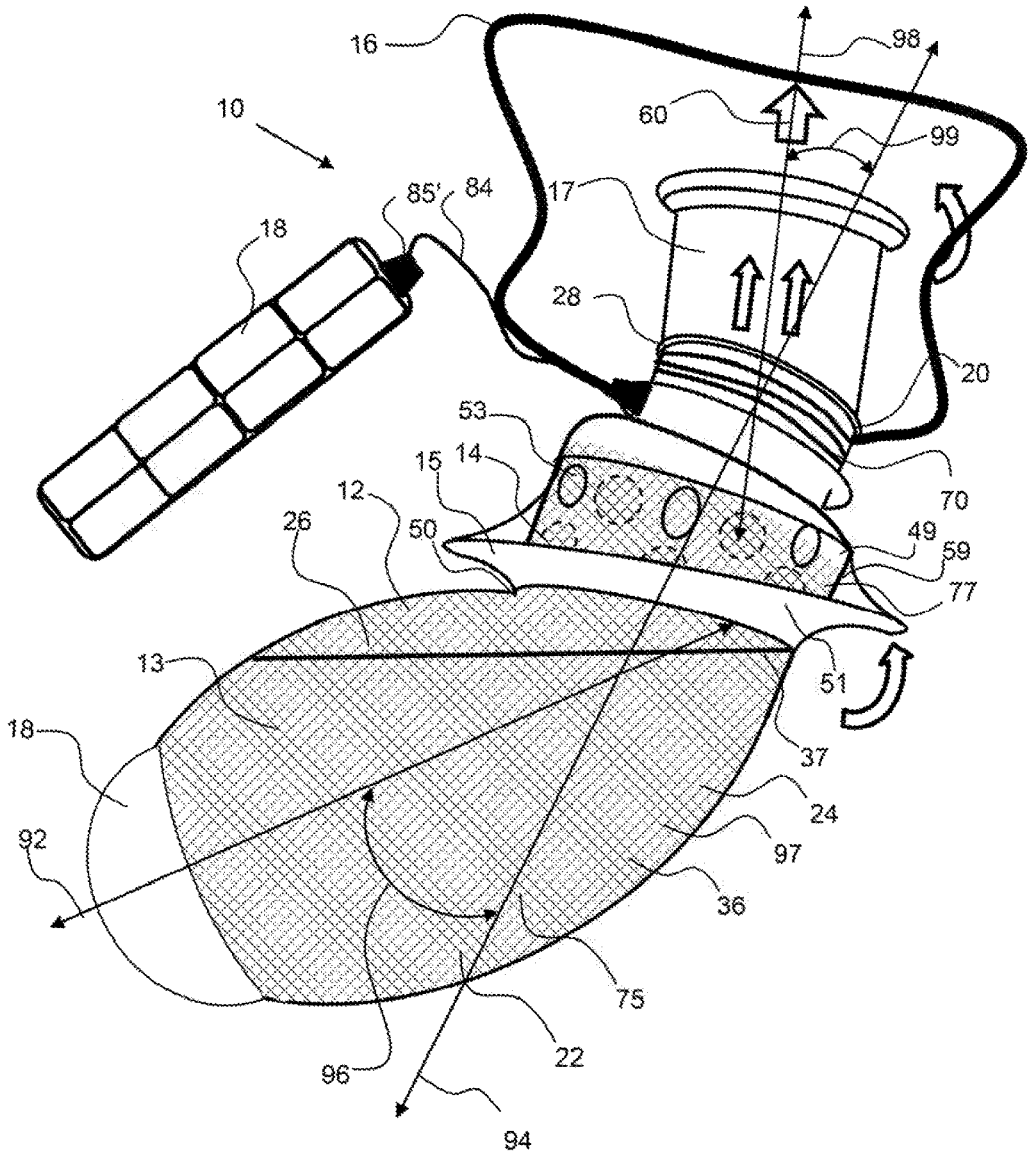
FIG. 14 shows a side view of the exemplary personal cooling device shown in FIG. 13 with the cooling device tilted as well as the funnel rotated to capture liquid in the rotated orientation.

As shown in FIG. 14, the exemplary personal cooling device shown in FIG. 13 has the cooling device 17 tilted to direct the flow of air upward even though the container is rotated. In addition, the funnel 15 is rotated counter to the rotation of the container to more effectively capture liquid 36. As shown, more water can be stored with reduce leakage through the apertures with a curved container 97. The personal cooling, device is tilted or rotated the air moving device is tilted or rotated opposite the rotation direction of the container to direct the flow of cooling air 60 upwards. The airflow offset angle 99 is the angle between the top axis 94 of the container and the airflow axis 98 of the container. The airflow axis is a line drawn in the direction of the flow of cooling air 60. The airflow offset angle may be controlled by manipulation of a flexible portion 70 as shown.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A personal cooling system comprising:

a) a portable container comprising:

i) a top having an opening;

ii) a bottom;

iii) an outer perimeter;

iv) a volume;

v) a plurality of apertures in the portable container proximal to the top; and vi) a reservoir portion configured between the bottom and the plurality of apertures for retaining a liquid;

b) a wicking material configured within the volume of the container and extending from the reservoir portion and up over the plurality of apertures;

wherein the wicking material wicks the liquid from the reservoir portion and into the wicking material that is configured over the plurality of apertures:

c) an air moving device that produces a flow of cool air from the container, wherein the air moving device is configured over the opening in the top of the portable container to draw air through the plurality of apertures, through the wicking material, out of the opening in the top of the container and through the air moving the device;

wherein the flow of cool air produced by evaporative cooling as the air moves through the wicking material configured over the plurality of apertures;

d) a funnel configured around the outer pen meter and configured below the plurality of apertures, wherein liquid retained within the container will be funneled back into the container when said liquid escapes from container through the plurality of apertures; and wherein the funnel is configured to receive liquid introduced into the container by pouring said liquid into the funnel, whereby the liquid is funneled into the container through the plurality of apertures.

2. The personal cooling system of claim 1, wherein the container is portable having a volume of no more than 2.0 liters.

3. The personal cooling system of claim 1, wherein the air moving device is detachably attachable to the portable container.

4. The personal cooling system of, claim 1, wherein the container comprises a circular cross-section.

5. The personal cooling system of claim 1, wherein the container has a height from the bottom to the top and wherein the plurality of apertures are configured above a mid-point of the length of the container from the bottom.

6. The personal cooling system of claim 1, wherein the plurality of apertures are configured substantially around the outer perimeter of the container, wherein at least one of said plurality of apertures is configured every 90 degrees about the outer perimeter of the container.

7. The personal cooling system of claim 1, wherein the wicking material extends around an inside perimeter of the container.

8. The personal cooling system of claim 1, wherein the air moving device is a fan.

9. The personal cooling system of claim 1, further comprising a battery pack for powering the fan and wherein the battery pack is attached to the container and is configured below the reservoir portion.

10. The personal cooling system of claim 1, further comprising a battery pack for powering the fan, wherein the battery pack is coupled to the fan by an extension cable having a length of at least 12 cm.

11. The personal cooling system of claim 1, further comprising a strap for hanging the container around a neck of a person;

wherein the flow of cool air is directed up at said person.

12. The personal cooling system of claim 1, wherein the container is a curved container having an offset angle between a bottom axis and a top axis.

13. The personal cooling system of claim 1, further comprising a flexible portion for directing the flow of cool air.

14. The personal cooling system of claim 13, wherein the flexible portion is a corrugated portion of the container.

15. The personal cooling system of claim 13, wherein the flexible portion is a corrugated portion coupled to the air moving device.

16. The personal cooling system of claim 1, wherein the funnel comprises a lower contacting portion and an extended end.

17. The personal cooling system of claim 16, wherein the funnel comprises an upper contacting portion and a funnel aperture configured between the extended end and the upper contacting portion.

18. The personal cooling system of claim 17, wherein the funnel comprises a plurality of funnel apertures configured substantially around the funnel, wherein one of said plurality of funnel apertures is configured every 90 degrees about the funnel.

19. The personal cooling system of claim 18, wherein the funnel comprises a fill port.

20. The personal cooling system of claim 19, wherein the funnel comprises a port cover that is detachably attachable to the fill port.

* * * * *